US008054237B2

(12) United States Patent
Suleiman et al.

(10) Patent No.: US 8,054,237 B2
(45) Date of Patent: Nov. 8, 2011

(54) COMPACT HIGH DEFINITION DIGITAL TELEVISION ANTENNA

(75) Inventors: Shady Hasan Suleiman, Burlington, IA (US); Gail Edwin McCollum, Wapello, IA (US)

(73) Assignee: Winegard Company, Burlington, IA (US)

( * ) Notice: Subject to any disclaimer, the term of this patent is extended or adjusted under 35 U.S.C. 154(b) by 376 days.

(21) Appl. No.: 12/474,119

(22) Filed: May 28, 2009

(65) Prior Publication Data

US 2010/0302118 A1 Dec. 2, 2010

(51) Int. Cl.
*H01Q 8/28* (2006.01)

(52) U.S. Cl. ..... 343/808

(58) Field of Classification Search ..... 343/808, 343/772, 776, 817
See application file for complete search history.

(56) References Cited

U.S. PATENT DOCUMENTS

| | | | |
|---|---|---|---|
| 2,338,564 | A | 1/1944 | Aram |
| 2,615,005 | A | 10/1952 | White |
| 2,665,380 | A | 1/1954 | Hickson et al. |
| 2,666,138 | A | 1/1954 | Ehrbar et al. |
| D171,560 | S | 2/1954 | Rutter |
| D174,992 | S | 6/1955 | Kumpis et al. |
| D175,733 | S | 10/1955 | Kumpis et al. |
| RE25,604 | E | 6/1964 | Greenberg |
| D202,709 | S | 11/1965 | Larson |
| 3,228,031 | A | 1/1966 | Kitamura et al. |
| D209,147 | S | 11/1967 | Johnson |
| 3,369,245 | A | 2/1968 | Rea |
| 3,373,432 | A | 3/1968 | Breneman |
| D211,179 | S | 5/1968 | Rosenberry et al. |
| 3,531,805 | A | 9/1970 | Winegard et al. |
| 3,665,478 | A | 5/1972 | Dempsey |
| 3,984,841 | A | 10/1976 | Mikulich, Jr. et al. |
| 4,149,169 | A | 4/1979 | Weber |
| 4,209,790 | A | 6/1980 | Newcomb |
| 4,219,821 | A | 8/1980 | Selim |
| 4,293,861 | A | 10/1981 | Winegard et al. |
| D293,786 | S | 1/1988 | Redaelli |
| D293,787 | S | 1/1988 | Redaelli |
| 4,766,441 | A | 8/1988 | Phillips et al. |
| D305,766 | S | 1/1990 | Tai |
| 5,696,372 | A | 12/1997 | Grober et al. |
| 5,969,687 | A | 10/1999 | Podger |
| 5,986,609 | A | 11/1999 | Spall |
| 6,057,805 | A | 5/2000 | Harrington |
| 6,154,182 | A | 11/2000 | McLean |
| 6,323,821 | B1 | 11/2001 | McLean |
| 6,466,178 | B1 | 10/2002 | Muterspaugh |
| 6,839,038 | B2 | 1/2005 | Weinstein |
| D501,466 | S | 2/2005 | Charlot, Jr. |
| D516,063 | S | 2/2006 | Lai et al. |
| 7,050,013 | B2 | 5/2006 | Kim et al. |
| 7,091,841 | B2 | 8/2006 | Adamson et al. |
| 7,142,166 | B2 | 11/2006 | Martek |
| D547,754 | S | 7/2007 | Oliver |
| 7,265,718 | B2 | 9/2007 | Tsai |

(Continued)

*Primary Examiner* — Huedung Mancuso
(74) *Attorney, Agent, or Firm* — Dorr, Carson & Birney, PC

(57) ABSTRACT

A compact digital television antenna having a pair of high band VHF triangular shaped dipoles with VHF signal outputs connected to a pair of terminals. A UHF reflector mounted to a bracket. Each VHF dipole having an outer linear portion connected to the bracket. The outer linear portions of the VHF dipoles forming opposing outer unitary type reflector elements in the UHF reflector. A V-shaped UHF antenna having its UHF signal outputs connected to the terminals. The pair of triangular shaped VHF dipoles forming a pyramidal support holding the UHF antenna at a fixed depth from the UHF reflector.

19 Claims, 9 Drawing Sheets

U.S. PATENT DOCUMENTS

| | | | |
|---|---|---|---|
| 7,439,926 | B2 | 10/2008 | Mikami et al. |
| 7,486,249 | B2 | 2/2009 | Fujita et al. |
| 7,498,993 | B1 | 3/2009 | Lee et al. |
| D590,379 | S | 4/2009 | Deguchi et al. |
| D594,857 | S | 6/2009 | Deguchi et al. |
| D606,057 | S | 12/2009 | Oliver |
| 7,626,557 | B2 | 12/2009 | Eckwielen et al. |
| 2002/0050954 | A1 | 5/2002 | Jeong-Kun et al. |
| 2003/0231138 | A1 | 12/2003 | Weinstein |
| 2005/0040994 | A1 | 2/2005 | Mazoki et al. |

700
702
704
706
708
709
710
712
713
714
715
716
717
723
13
14
70
80
86
90a
90b
62a
52d
40
41
43
44

COMPACT HIGH DEFINITION DIGITAL TELEVISION ANTENNA

BACKGROUND OF THE INVENTION

1. Field of the Invention

The invention relates to the field of very high frequency (VHF) and ultrahigh frequency (UHF) television antennas and, more particularly, to high definition digital television (HDTV) antennas.

2. Discussion of the Background

Consumer television antennas for receiving UHF and VHF broadcast television programming signals are well known.

An example of an early UHF antenna is U.S. Pat. No. 3,373,432 which uses a pair of V-shaped receiving dipoles (also known as a bow-tie) along with a rectangular reflector positioned rearwardly of the dipoles. In this design, the apex portion of each dipole is connected to an insulating spacing support to provide a pair of signal outputs that are spaced apart. A twin lead wire connects to the signal outputs for delivery of the UHF signals from the antenna. The insulating spacing support connects to a spacing bracket that spaces the dipoles from the reflector.

Another example of an early UHF antenna is U.S. Pat. No. 3,369,245 which seeks to maintain a working efficiency over at least a 2 to 1 range between the lowermost frequency and the uppermost frequency of the UHF band. Here, quarter wave stub extensions to the receiving dipoles are used to obtain the desired working efficiency.

U.S. Pat. Nos. 3,531,805 and 4,209,790 also set forth the use of stubs to enhance antenna performance.

HDTV digital signals are broadcast in the high VHF and UHF bands with a change. While the high VHF band remains at 174 to 216 MHz, the UHF band has changed to 470 to 698 MHz which is narrower than before. A need exists to provide VHF and UHF antennas optimized to receive high definition television (HDTV) digital signals in the narrower UHF band and in the high VHF band. A further need exists for a low cost, compact HDTV antenna for use outdoors or indoors that has an aesthetic appearance.

SUMMARY OF THE INVENTION

The compact digital television antenna of the invention meets the above needs by using the high band VHF antenna to support the UHF antenna a fixed depth from the UHF reflector.

A compact digital television antenna of the invention having a high band VHF antenna with a pair of substantially triangular shaped VHF dipoles. Each VHF dipole having sides terminating in a pair of VHF signal outputs that are connected to a pair of terminals spaced apart on an insulator. Each VHF dipole having an outer linear portion opposite the VHF signal outputs connected to a support bracket. A UHF reflector connected to the support bracket. The outer linear portions of the VHF dipoles forming opposing outer unitary type reflector elements in the UHF reflector on the support bracket. The VHF dipoles are spaced apart at a set angle by said outer linear portions on the support bracket to hold the terminals a fixed depth from the UHF reflector. A V-shaped UHF antenna having a pair of UHF signal outputs connected to the terminals. The pair of substantially triangular shaped VHF dipoles forming a substantially pyramidal mount holding the UHF antenna at the fixed depth from the UHF reflector.

The summary set forth above does not limit the teachings of the invention especially as to variations and other embodiments of the invention as more fully set out the following description taken in connection with the accompanying drawings.

DETAILED DESCRIPTION OF THE INVENTION

Figure 1:
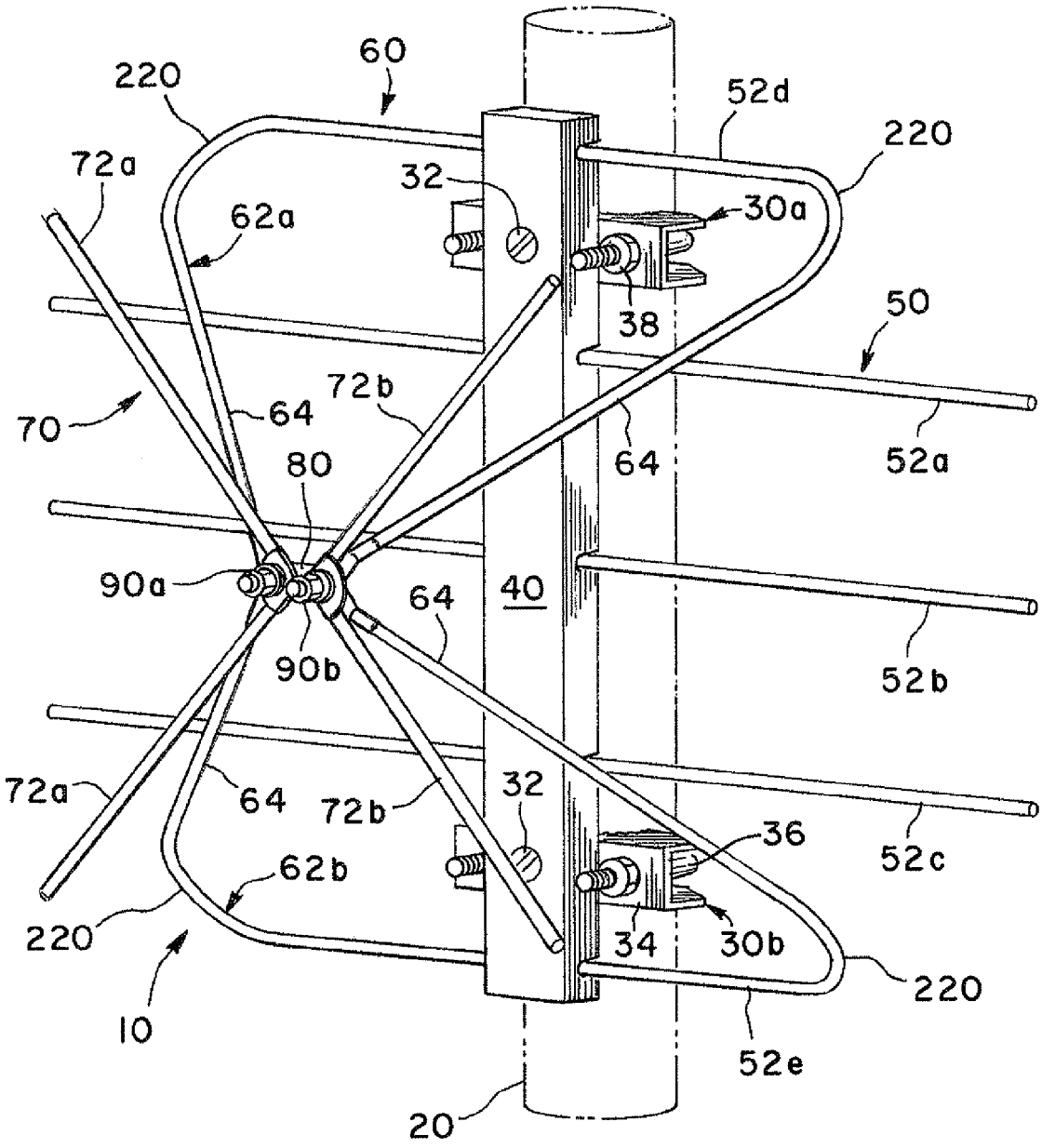
FIG. 1 is a perspective view of a first embodiment of the compact high definition television antenna of the invention.

FIG. 1 shows a first embodiment of the HDTV compact digital antenna 10 of the invention mounted to a post 20 using clamps 30*a* and 30*b*. The HDTV antenna 10 can be mounted on any post 20: outside in the environment such as on a pole or on a roof or indoors such as on a suitable support member in an attic or room.

The HDTV digital compact antenna 10 includes an elongated support bracket 40, a UHF reflector 50 having five elements 52*a*, 52*b*, 52*c*, 52*d*, and 52*e*; a high band VHF antenna 60 having two formed triangular shaped dipole elements 62*a* and 62*b*; a UHF antenna 70 having two V-shaped dipole elements 72*a* and 72*b*; an insulator 80 and two common downlead terminals 90*a* and 90*b*.

The elongated support bracket 40 is mounted to post 20 by clamps 30*a*, 30*b*. Any number of clamps 30*a*, 30*b* can be utilized depending on the support 20 and the environment of use. Two clamps are typically used.

As shown in FIG. 1, the high band VHF antenna 60 functions to support the UHF antenna 70 away from the elongated support bracket 40 and further functions to provide upper and lower UHF reflector elements 52*d* and 52*e* in the reflector 50.

Figure 2:
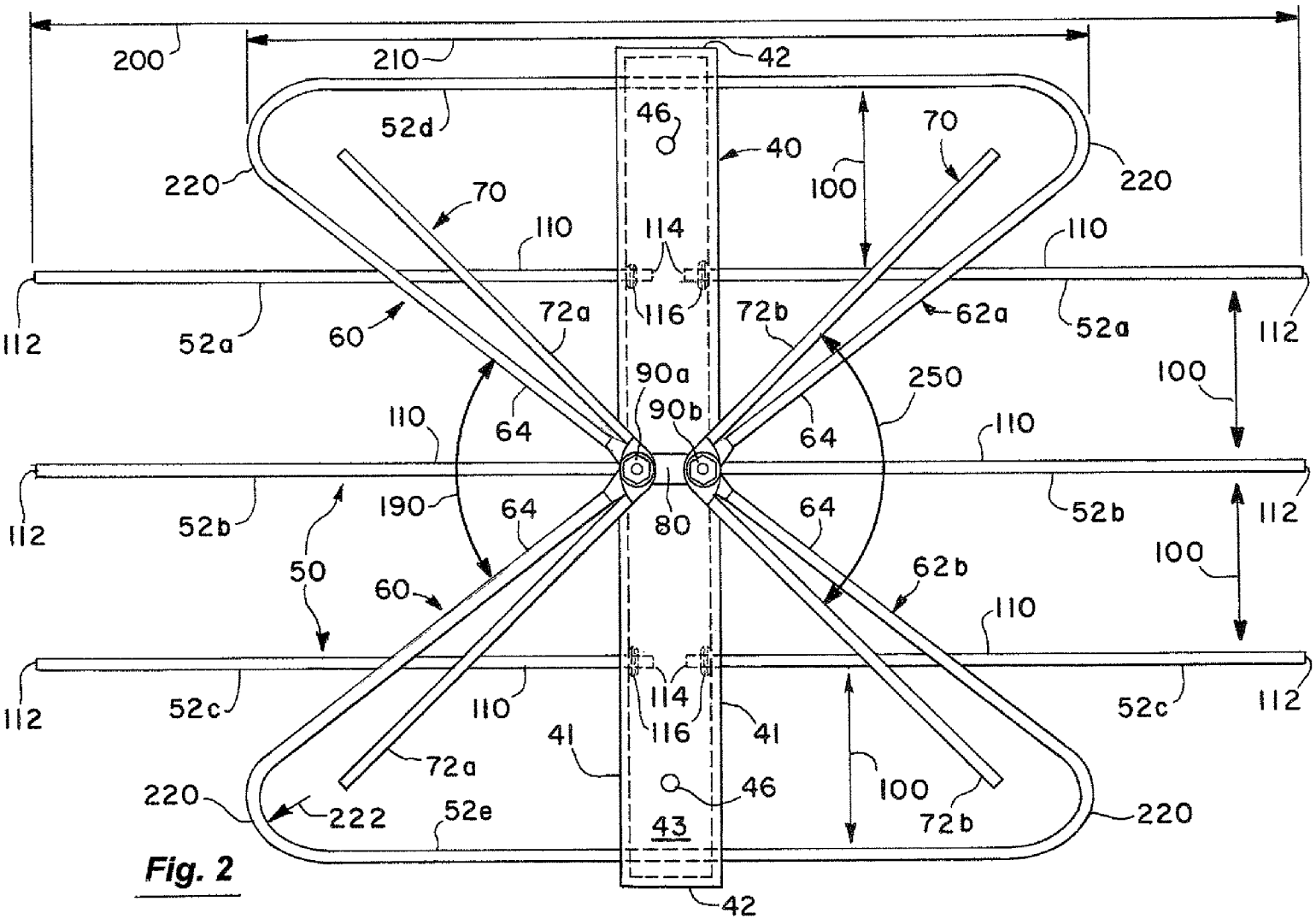
FIG. 2 is a front planar view of the compact high definition television antenna of FIG. 1.
Figure 3:
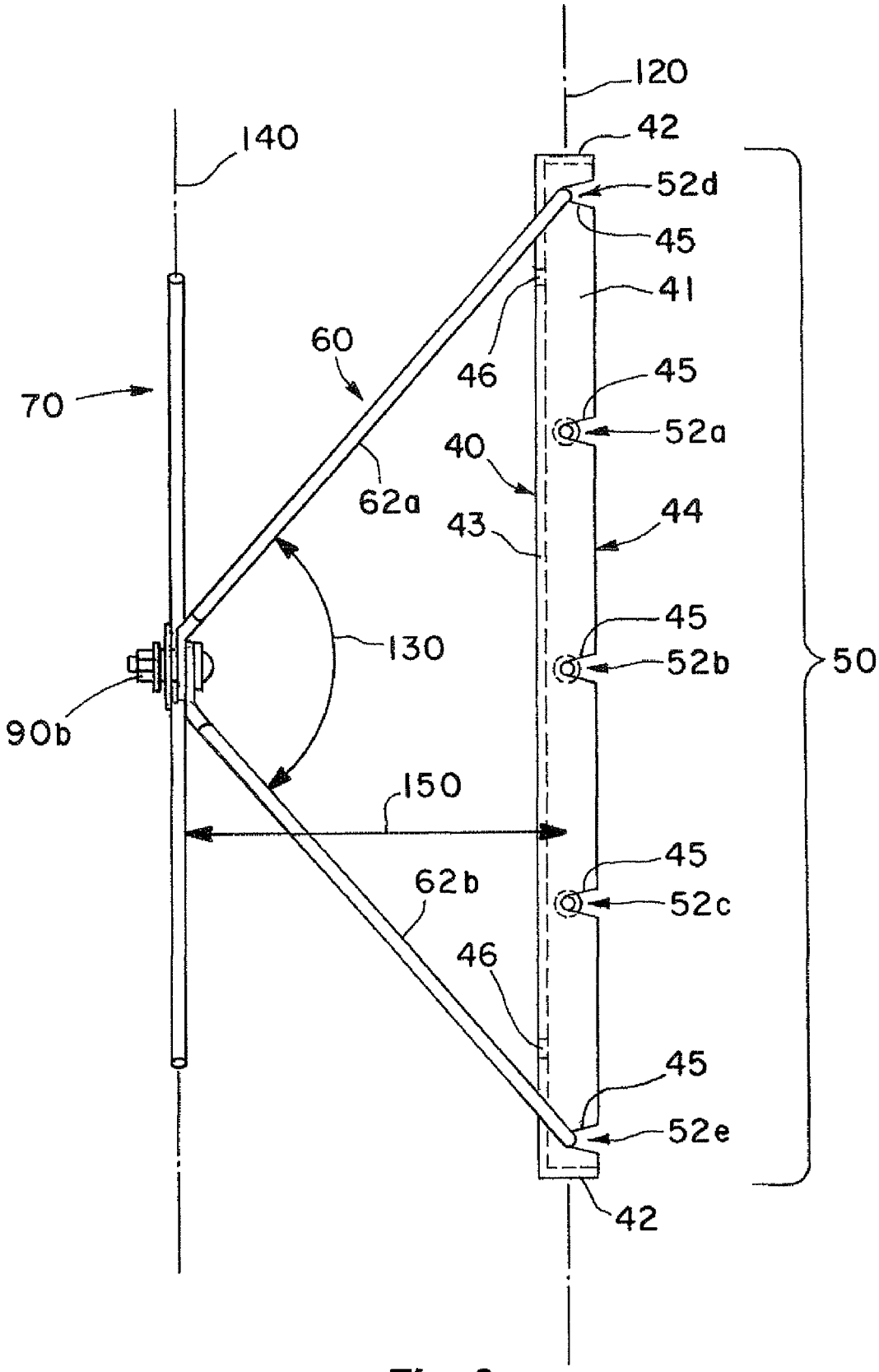
FIG. 3 is a side planar view of the compact high definition television antenna of FIG. 1.
Figure 4:
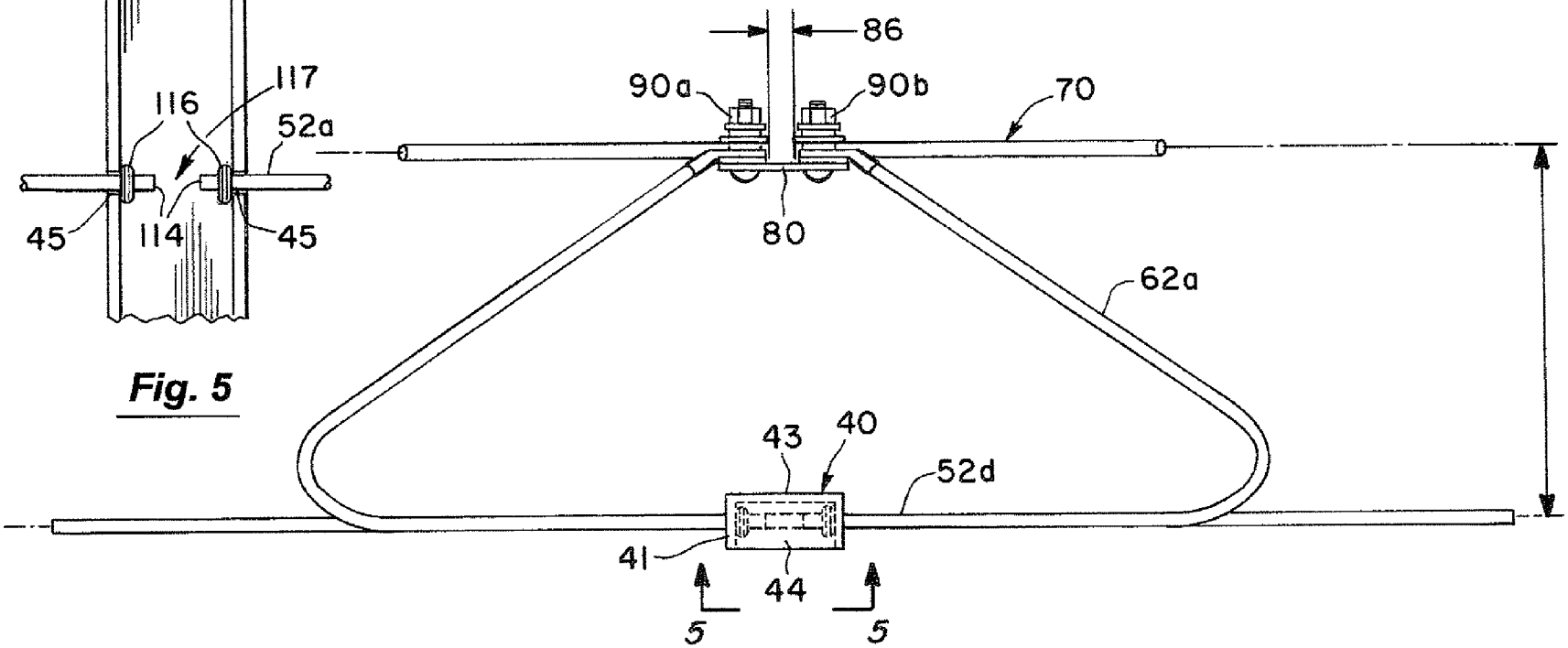
FIG. 4 is a top planar view of the compact high definition television antenna of FIG. 1.
Figure 5:
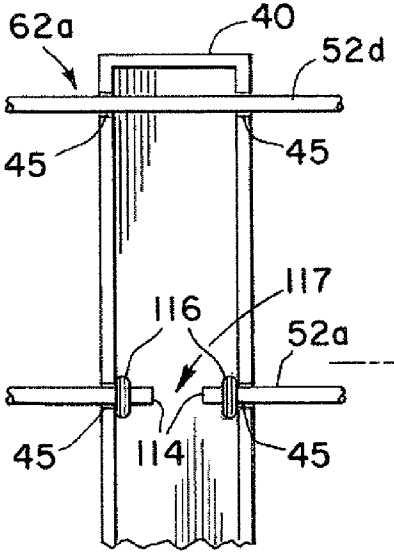
FIG. 5 is a cut-away view along lines 5-5 of the elongated support bracket of the compact high definition television antenna of FIG. 4.

The elongated support bracket 40 is formed from non-conductive material such as, for example, plastic or other suitable material. As best shown in FIGS. 2, 3 and 4, the elongated support bracket 40 is formed in a channel having elongated opposing edges 41 with opposing ends 42, an elongated side 43 and an opposite open side 44. On each elongated edge 41 of the channel and shown in FIGS. 4 and 5 are five formed opposing pairs of tapered slots 45. Two holes 46 are formed in elongated side 43 to receive bolts 32 (FIG. 1) which are used to firmly hold each clamp 30*a* and 30*b* to the elongated support bracket 40. The locking nut on bolt 32 is not shown. Any suitable connection arrangement can be used including one that has self holding features.

As shown in FIG. 1 each clamp 30*a*, 30*b* is conventional having a channel component 34, a threaded U-shaped component 36, and nuts 38. Clamps 30*a*, 30*b* are conventional and vary in design. How each clamp 30*a*, 30*b* is attached to the elongated support bracket 40 and post 20 can vary from what is shown.

The above design of the elongated support bracket 40 is optimized for compactness and low cost. Any suitable elongated bracket 40 can be used and the invention 10 is not limited to the design shown.

The UHF reflector 50 is shown to have five parallel elements 52*a*, 52*b*, 52*c*, 52*d*, and 52*e* in FIGS. 1, 2, and 3 connected in a plane 120 on the support bracket 40. Elements 52*a*, 52*b* and 52*c* are each separate reflector dipole type elements and reflector unitary type elements 52*d* and 52*e* are part of the high band VHF antenna 60. Elements 52*a*, 52*b*, 52*c*, 52*d*, and 52*e* are collectively referred to as reflector elements 52 in reflector 50. As shown in FIG. 2, each reflector element 52 is equally spaced 100 from an adjacent reflector element 52 on the elongated support bracket 40. Spacing 100 is preferably three inches which is efficient and is approximately 0.15 wavelength at the low end of the UHF band.

As shown in FIG. 2, reflector dipole type elements 52*a*, 52*b*, and 52*c* are each formed of two identical half elements 110 connected to the elongated support bracket 40. Half element 110 has an outwardly extending end 112 and a threaded end 114. Each threaded end 114 firmly connects to a tapered slot 45 in an elongated edge 41 with a nut 116 as shown in better detail in FIG. 5. An air gap 117 of preferably 0.5 inches provides a nominal dimension in forming the reflector dipole elements 52*a*, 52*b*, and 52*c* shown. Half elements 110 are formed of aluminum or other suitable material. Each half element 110 has a preferable length of 9.5 inches. As shown in FIG. 2, the preferable length 200 of reflector dipole type elements 52*a*, 52*b*, and 52*c* is of an equal length of 19.5 inches. Length 200 provides a full wave resonance at the low end of the UHF band thereby increasing the low end UHF gain by increasing the capture area of UHF antenna 70.

As shown in FIG. 3, the reflector 50 with reflector dipole type elements 52*a*, 52*b*, and 52*c* and reflector unitary type elements 52*d* and 52*e* are held in a plane 120 that preferably corresponds with the centerline of the elongated support bracket 40. The diameter of each reflector element 52 is preferably 0.188 inch.

While the above design is optimized for the invention for compactness and low cost, the reflector 50 is not limited to the design shown and may include more or less than the five reflector elements 52. Further, the lengths of half elements 110 need not be identical. And, the use of half elements 110 are not required as a unitary single rod can be used providing a shorter length such as one-half wavelength resonance at the low end of the UHF band. Any combination of dipole or unitary type elements can be used for reflector 50. The reflector 50 can also be formed as a partial or full grid of square, rectangular, or any other desired shape. Further, the reflector 50 can be connected to the elongated support bracket 40 in a wide variety of other conventional mechanical designs: such as on or spaced from side 43 or from open side 44.

The high band VHF antenna 60 has two substantially triangular shaped VHF dipoles 62*a* and 62*b* as shown in FIGS. 1 and 2. Each dipole 62*a*, 62*b* has sides 64 and an outer linear portion 52*d*, 52*e*. In FIG. 3, the dipoles 62*a* and 62*b* are spaced apart at a set angle 130 of preferably 97 degrees by the outer linear portions 52*d*, 52*e* connected to the support bracket 40. As shown in FIG. 2, the dipoles 62*a* and 62*b* are separated by an angle 190 of preferably 75.8 degrees.

In FIG. 3, high band VHF antenna 60 functions to support the UHF antenna 70 in a parallel plane 140 at a depth 150 of preferably five inches from the reflector plane 120. This depth 150 provides optimum antenna performance. The depth 150 is a function of set angle 130 which is controlled by where the outer linear portions 52*d* and 52*e* are attached to the support bracket 40 and the length of the sides 64. Set angle 130 places the outer linear portions 52*d* and 52*e* of the VHF dipole elements 62*a* and 62*b* in the reflector plane 120. The pair of outer linear portions 52*d* and 52*e* of the VHF antenna 60 engage the outermost opposing tapered slots 45 of the elongated support bracket 40 which are located preferably twelve inches apart.

With reference to FIG. 5, each outer linear portion 52*d*, 52*e* passes through the tapered slots 45 of the elongated support bracket 40. As shown in FIG. 2, the length 210 of each outer linear portions 52*d*, 52*e* is preferably 13 inches. The outer linear portions 52*d* and 52*e* of the dipoles 62*a* and 62*b* of VHF antenna 60 also function as half wave unitary type UHF reflector elements. The same structure 52*d*, 52*e*, as labeled, are the outer linear portions of the VHF antenna 60 and the outer reflector unitary type elements of reflector 50 and function as part of the VHF antenna 60 and part of the reflector 50.

Figure 6:
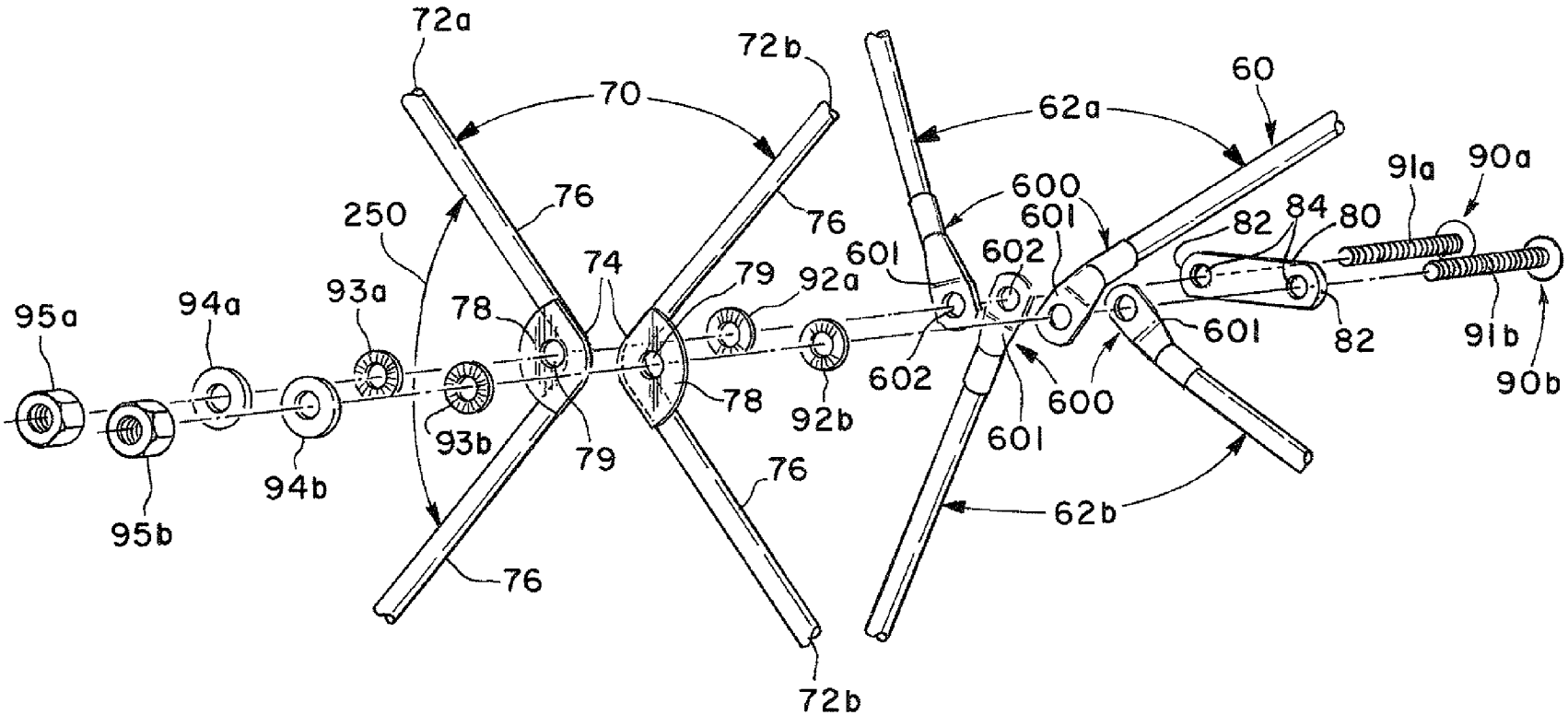
FIG. 6 is an exploded view of the common downlead terminals of the compact high definition television antenna of FIG. 1.

Each dipole element 62*a* and 62*b* of high band VHF antenna 60 forms a continuous loop terminating in a pair of VHF signal outputs 600 which are shown as lugs 601 with formed holes 602 in FIG. 6. Each substantially V-shaped dipole element 62*a*, 62*b* undergoes two bends 220 (FIG. 2) with each bend 220 having a true, inside radius of preferably 1.375 inches. The diameter of each dipole element is preferably 0.188 inch and is formed from a rod of aluminum material having a length of preferably 31.75 inches.

High band VHF antenna 60 provides VHF antenna performance, supports the UHF antenna 70 at a fixed depth 150 from the reflector 50 and parallel to the reflector plane 120, and provides unitary reflector elements 52*d* and 52*e* in the reflector 50. As shown in FIG. 1, antenna 60 forms a substantial pyramidal support starting in the four curved corners 220 where the outer linear portions 52*d*, 52*e* are held at opposing ends of the reflector 50, continuing along sides 64, and ending at the signal outputs 600 on the insulator 80 to firmly hold the UHF antenna 70 in position even in the presence of environmental forces such as wind and snow.

In summary, a high band VHF antenna 60 having a pair of substantially triangular shaped VHF dipoles 62*a*, 62*b* is set forth. Each VHF dipole has sides 64 terminating in a pair of VHF signal outputs 600 connected to a pair of terminals 90. Each VHF dipole 62*a*, 62*b* also has an outer linear portion 52*d*, 52*e* opposite the signal outputs 600 and connected to the support bracket 40. The outer linear portions 52*d*, 52*e* also function as opposing outer unitary type reflector elements of the UHF reflector 50. The pair of VHF dipoles 62*a*, 62*b* are spaced apart at a set angle 130 by connection of the outer linear portions 52*d*, 52*e* to the support bracket 40 in order to hold the pair of terminals 90 a fixed depth from the UHF reflector 50.

While the above design is optimized for compactness and low cost, the high band VHF antenna 60 is not limited to the design shown. Variations in angles, spacings, dimensions, configurations and dipole shapes as well as materials can occur without departing from the invention.

The UHF antenna 70 has two opposing V-shaped dipole elements 72*a* and 72*b*. As shown in FIGS. 2 and 6, each V-shaped dipole element forms an angle 250 of preferably 91 degrees about its vertex 74. This vertex angle 250 provides good antenna patterns and gain across the UHF band. The length of each of the two legs 76 of each V-shaped dipole element 72*a*, 72*b* is preferably 7 inches which is approximately one-half wavelength at the center of the UHF band. The diameter of each V-shaped dipole element is preferably 0.188 inch. A flattened contact area 78 with a formed hole 79 is formed at the vertex 74.

The UHF antenna is held in a plane 140, as shown in FIG. 3, a fixed depth 150 that is preferably five inches from the reflector plane 120 and centered over the reflector plane 120 as shown in FIG. 2. Depth 150 is optimal for antenna performance.

While the above design is also optimized for compactness and low cost, the UHF antenna 70 itself is not limited to the design shown and may be any conventional UHF antenna.

In FIG. 6, the insulator 80 is a rectangular block with curved ends 82 with formed holes 84 that are spaced apart. The insulator has a thickness of preferably 0.090 inch and is preferably made of plastic ABS or other suitable insulating material. The insulator 80 serves as a support, maintains a terminal spacing 86 of about one inch, as shown in FIG. 4, and controls the impedance of the antenna 10.

In FIG. 6, the details of the terminals 90*a*, 90*b* are shown to firmly connect the signal outputs of the high band VHF antenna 60 and the UHF antenna 70 on the insulator 80 and provide a conventional downlead lead of 300 ohms impedance. Bolts 91*a*, 91*b* pass through holes 84 of the insulator 80; holes 602 of lug 601; lock washers 92*a*, 92*b*; holes 79 of flattened areas 78; lock washers 93*a*, 93*b*; and washers 94*a*, 94*b*. Nuts 95*a*, 95*b* tighten the assembly together as shown in FIG. 3 to form the terminals 90*a*, 90*b*.

While the above design is preferred, it is not limited to the design shown as any conventional connection system could be utilized.

In FIGS. 7 through 14, the second embodiment of the invention is shown being a larger version of the above design. Except for the new components, the reference numerals used above correspond in this embodiment. The length 210 is increased to preferably 18 inches, the length 200 is maintained at preferably 19.5 inches, the depth 150 is maintained at preferably 5 inches and the spacings 100 are maintained at preferably 3 inches. The angle 250 is maintained at preferably 91 degrees, the angle 190 is lowered to preferably 56.4 degrees and the angle 130 is maintained at preferably 97 degrees. The increase in length 210 increases VHF gain, but generates a suck out (notch) in the UHF band at about 615 MHz requiring the use of stub elements 700.

Stub elements 700 are connected to the high band VHF antenna 60 to improve performance of the UHF antenna 70 at the low end of the UHF band. The details of each stub element 700 shown in FIGS. 11 through 14 include: an elongated body portion 702 terminating in a curved end 704, a rib 706 providing structural strength, an angled connection portion 708 terminating in a loop 710 with a formed threaded hole 712. The elongated body portion 702 has a length 714 of preferably 4.5 inches and the integral angled connection portion 708 has a length 716 of preferably 0.625 inch from the center of the loop 710 and is part of the overall stub element 700 length. The width 715 of the stub element 700 is preferably 0.312 inches. A screw 723 is used to engage threaded hole 712 to tighten the loop 710 to the VHF dipole side.

Figure 9:
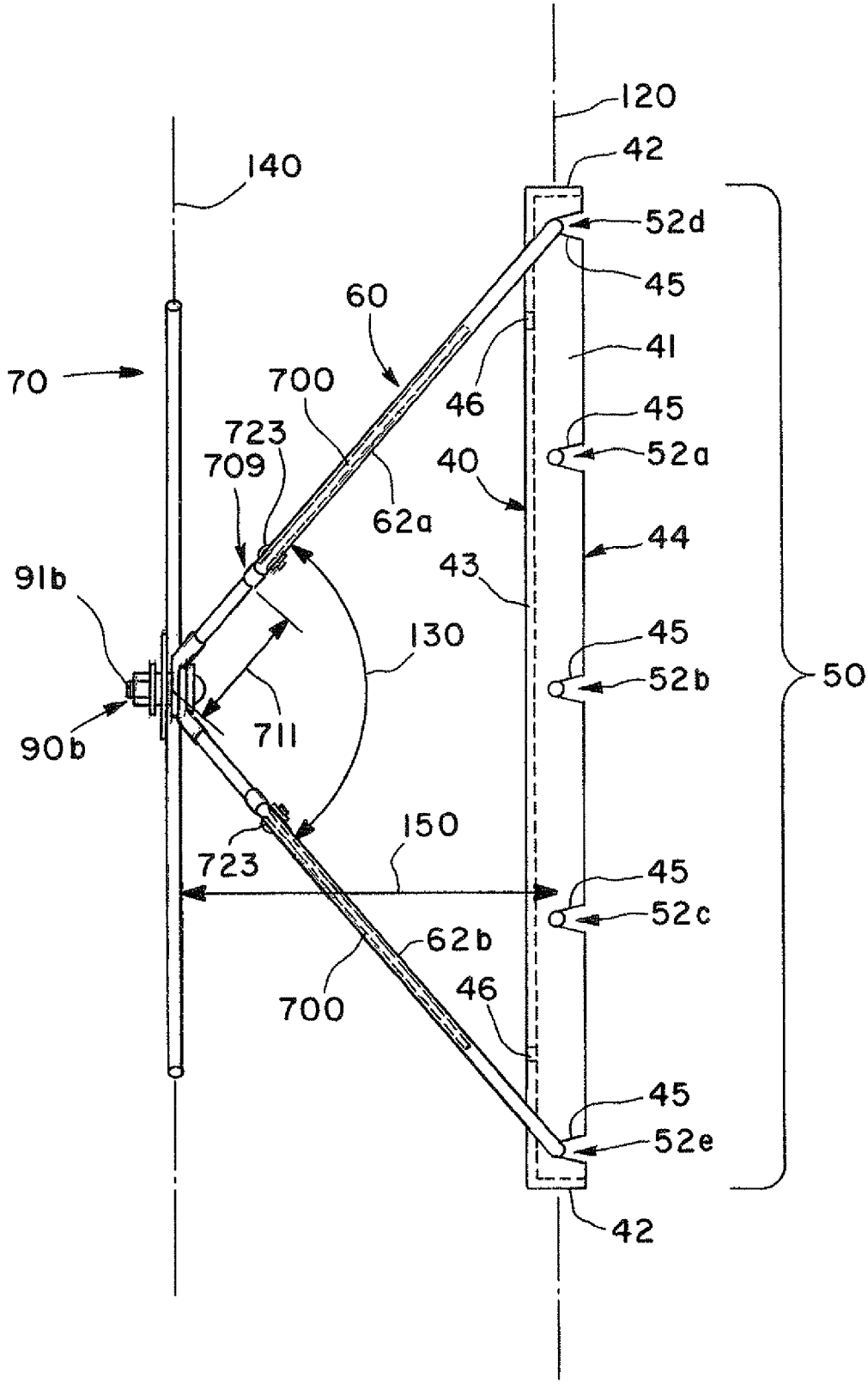
FIG. 9 is a side planar view of the compact high definition television antenna of FIG. 7.
Figures 10, 11, 12, 13, 14:
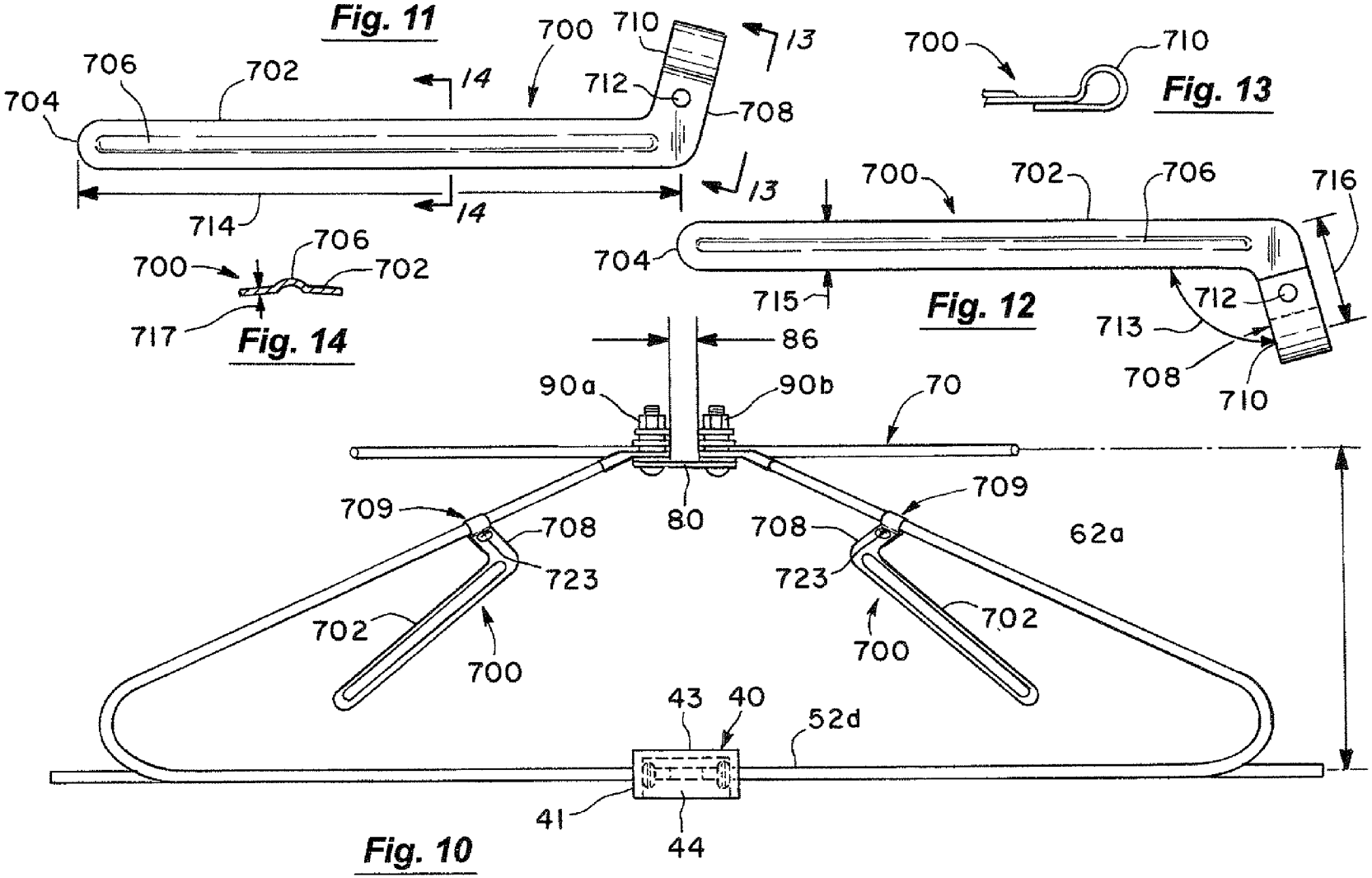
FIG. 10 is a top planar view of the compact high definition television antenna of FIG. 7.
FIG. 11 is a first side planar view of the UHF stub element in the compact high definition television antenna of FIG. 7.
FIG. 12 is a second side planar view of the UHF stub element of FIG. 11.
FIG. 13 is a view of the UHF stub element of FIG. 11 along lines 13-13.
FIG. 14 is an end planar view of the UHF stub element of FIG. 11.

At point 709, as shown in FIG. 10, where the one-quarter wavelength UHF stub elements 700 are connected to the VHF antenna 60, the UHF currents are corrected to be in phase for the embodiment shown. Point 709, as shown in FIG. 9 is at a set distance 711 of preferably 3.25 inches from the center of bolt 91*b*. The angle 713 of the stub elements 700 is preferably 105 degrees but can be in a range starting from 90 degrees. As shown a pair of stub elements 700 are connected at point 709 to the opposing sides of each VHF dipole 62*a* and 62*b* at a set distance from the common downlead terminals 90*a* and 90*b*.

As shown in FIG. 9, the stub elements 700 align with the VHF dipoles 62*a* and 62*b*.

Figure 7:
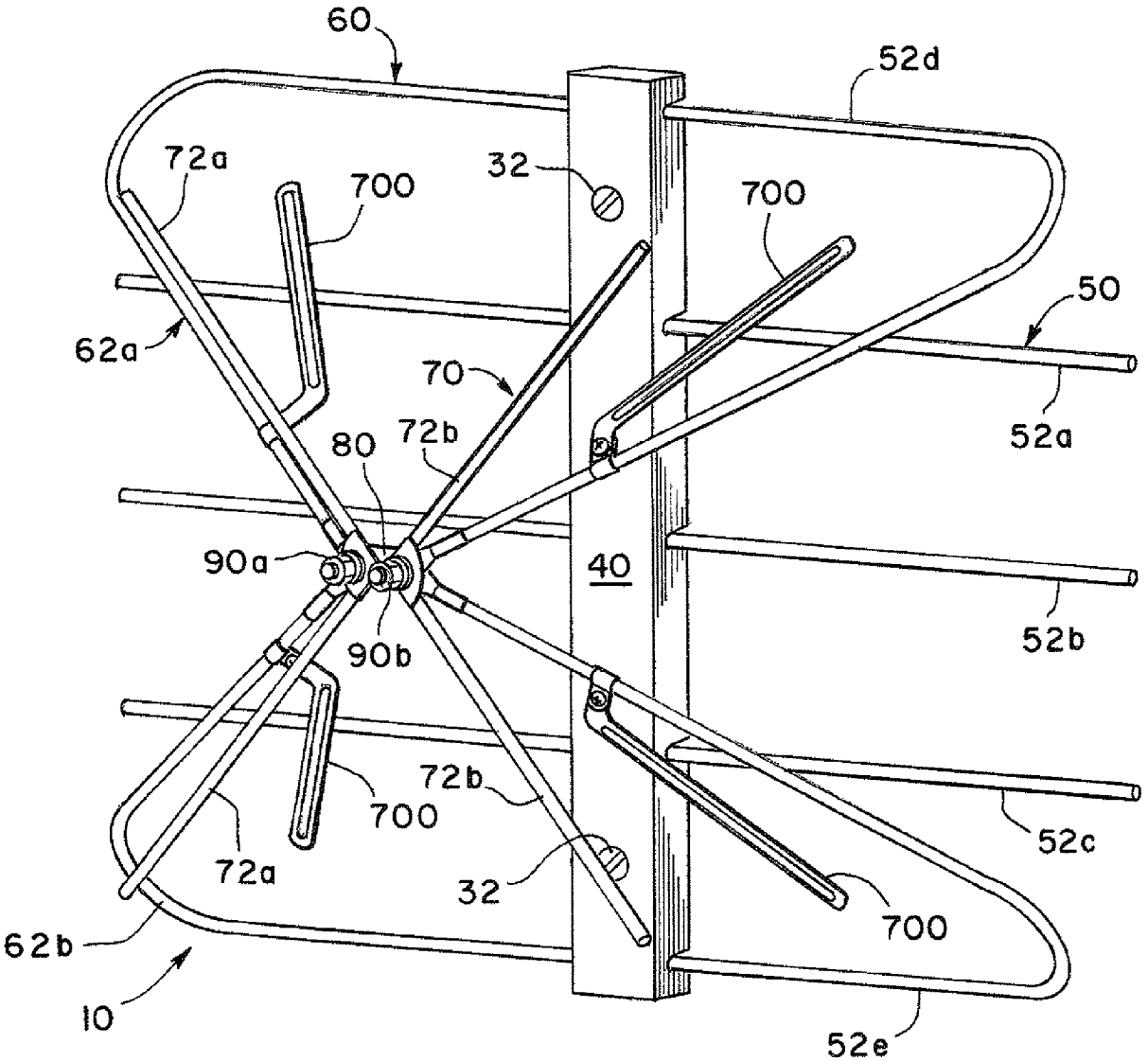
FIG. 7 is a perspective view of a second embodiment of the compact high definition television antenna of the invention.
Figure 8:
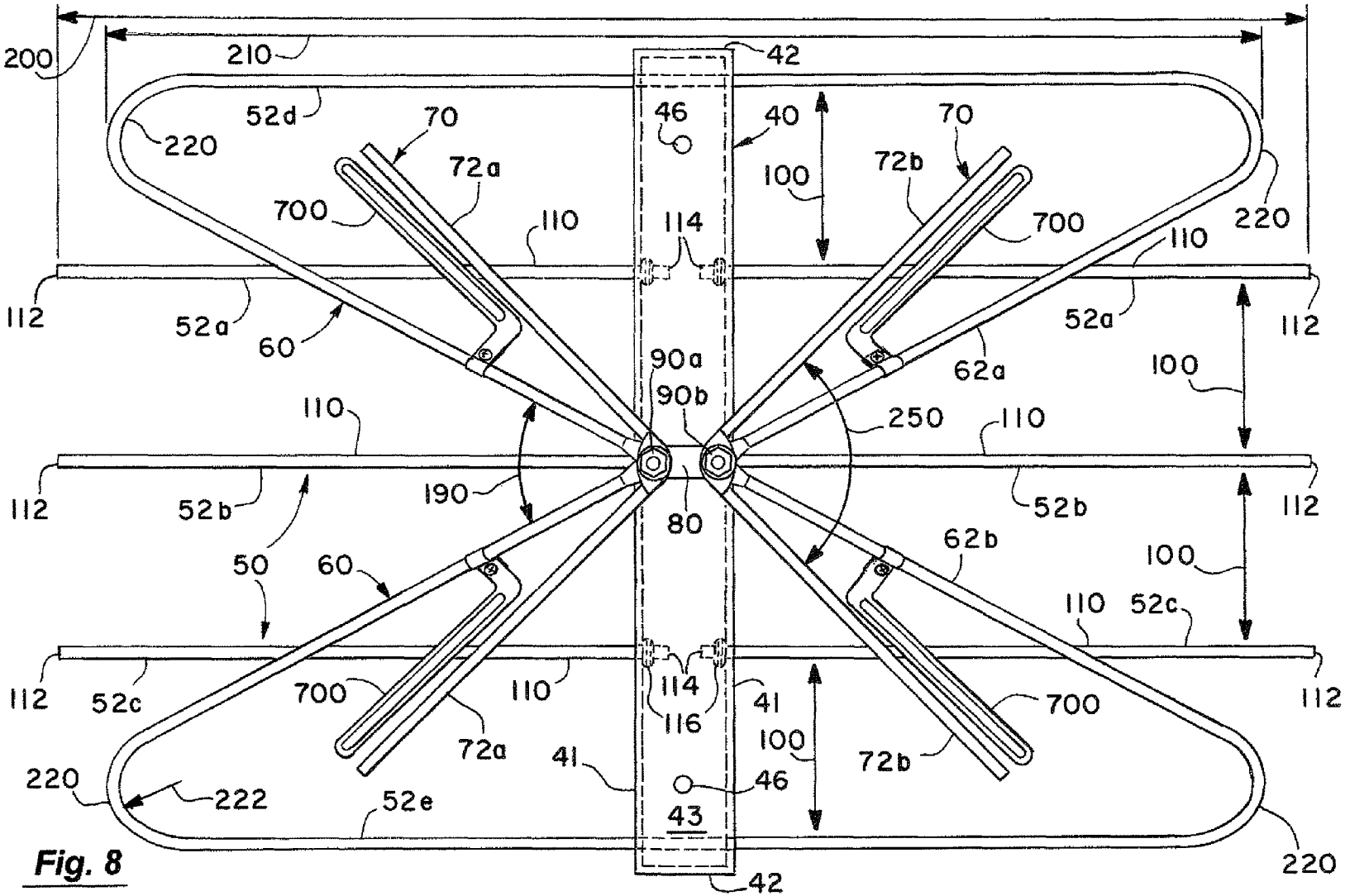
FIG. 8 is a front planar view of the compact high definition television antenna of FIG. 7.

The high definition antenna set forth above is compact. The embodiments of FIGS. 1 and 7 are each about 5 inches deep, 12 inches tall and 20 inches wide.

The above disclosure sets forth two basic embodiments of the invention described in detail with respect to the accompanying drawings with a wide number of variations discussed.

Certain precise dimension values have been utilized in the specification. However, these dimensions do not limit the scope of the claimed invention and that variations in angles, spacings, dimensions, configurations, and dipole shapes can occur.

It is noted that the terms "preferable" and "preferably," are given their common definitions and are not utilized herein to limit the scope of the claimed disclosure. Rather, these terms are intended to highlight alternative or additional features that may or may not be utilized in a particular embodiment of the present disclosure.

For the purposes of describing and defining the present disclosure it is noted that the term "substantially" is given its common definition and it utilized herein to represent the inherent degree of uncertainty that may be attributed to any shape or other representation.

Those skilled in this art will appreciate that various changes, modifications, use of other materials, other structural arrangements, and other embodiments could be practiced under the teachings of the invention without departing from the scope of this invention as set forth in the following claims.

We claim:

1. A compact digital television antenna comprising in combination:

a support bracket;

an ultrahigh frequency reflector connected to said support bracket;

an insulator;

a pair of terminals spaced apart on said insulator;

a high band very high frequency antenna having a pair of substantially triangular shaped very high frequency dipoles, each of said pair of very high frequency dipoles having sides terminating in a pair of very high frequency signal outputs, said pair of very high frequency signal outputs connected to said pair of terminals, each of said pair of very high frequency dipoles having an outer linear portion opposite said pair of very high frequency signal outputs and connected to said support bracket, said outer linear portions of said pair of very high frequency dipoles forming opposing outer unitary reflector elements of said ultrahigh frequency reflector on said support bracket, said pair of very high frequency dipoles spaced apart at a set angle by said outer linear portions connected to said support bracket to hold said pair of terminals a fixed depth from said ultrahigh frequency reflector;

an ultrahigh frequency antenna, said ultrahigh frequency antenna having a pair of ultrahigh frequency signal outputs connected to said pair of terminals, said ultrahigh frequency antenna held at said fixed depth from said ultrahigh frequency reflector by said very high frequency antenna.

2. The compact digital television antenna of claim 1 wherein said support bracket is formed in an elongated channel of non-conductive material.

3. The compact digital television antenna of claim 2 wherein said ultrahigh frequency reflector comprises:

a plurality of reflector dipole type elements connected to said elongated support bracket;

said plurality of reflector dipole type elements located on said elongated support bracket between said opposing outer unitary type reflector elements;

said plurality of reflector dipole type elements and said opposing outer reflector unitary type elements positioned on said elongated support bracket in a plane.

4. The compact digital television antenna of claim 3 wherein each of said plurality of reflector dipole type elements and each of said opposing outer reflector unitary type elements are parallel and equally spaced from each other on said elongated support bracket.

5. The compact digital television antenna of claim 4 wherein said equal spacing is about 0.15 wavelength at the low end of the very high frequency band.

6. The compact digital television antenna of claim 3 wherein each of said plurality of reflector dipole type elements is of equal length.

7. The compact digital television antenna of claim 6 wherein said equal length provides a full wave length resonance at the low end of the ultrahigh frequency band.

8. The compact digital television antenna of claim 3 wherein said ultrahigh frequency reflector is held in a number of formed opposing tapered slots in said elongated channel, the aforesaid number equals the number of said plurality of reflector dipole type elements plus said two opposing outer reflector unitary type elements.

9. The compact digital television antenna of claim 8 wherein the number of formed opposing tapered slots is five and the number of said plurality of reflector dipole type elements is three.

10. The compact digital television antenna of claim 1 wherein said pair of very high frequency dipoles form a substantial pyramidal support from said support bracket to said pair of terminals on said insulator.

11. The compact digital television antenna of claim 1 wherein said ultrahigh frequency antenna comprises two opposing V-shaped ultrahigh frequency dipoles.

12. The compact digital television antenna of claim 1 further comprising:

a pair of ultrahigh frequency stub elements connected to said opposing sides of each of said pair of very high frequency dipoles at a set distance from said pair of signal outputs.

13. The compact digital television antenna of claim 12 wherein each said ultrahigh frequency stub element comprises:

an elongated body portion;

an angled connection portion integral with said elongated body portion, said angled portion terminating in a loop for connecting to said opposing side of said very high frequency dipole.

14. A compact digital television antenna comprising:

an elongated support bracket;

an ultrahigh frequency reflector connected to said elongated support bracket, said ultrahigh frequency reflector having a plurality of reflector dipole type elements connected to said elongated support bracket;

an insulator;

a pair of terminals spaced apart on said insulator;

a high band very high frequency antenna having a pair of very high frequency dipoles, each of said pair of very high frequency dipoles having sides terminating in a pair of very high frequency signal outputs, said pair of very high frequency signal outputs connected to said pair of terminals, each of said pair of very high frequency dipoles having an outer linear portion opposite said pair of very high frequency signal outputs and connected to said support bracket, said outer linear portions of said pair of very high frequency dipoles forming opposing outer unitary reflector type elements of said ultrahigh frequency reflector on said support bracket, said pair of very high frequency dipoles spaced apart at a set angle by said outer linear portions connected to said support bracket to hold said pair of terminals a fixed depth from said ultrahigh frequency reflector;

each of said plurality of reflector dipole type elements and each of said opposing outer reflector unitary type elements parallel and equally spaced from each other on said elongated support bracket;

an ultrahigh frequency antenna, said ultrahigh frequency antenna having a pair of ultrahigh frequency signal outputs connected to said pair of terminals, said pair of very high frequency dipoles forming a substantially pyramidal mount from said support bracket to said pair of terminals on said insulator to hold said ultrahigh frequency antenna said fixed depth from said ultrahigh frequency reflector.

15. The compact digital television antenna of claim 14 wherein each of said plurality of reflector dipole type elements is of equal length.

16. The compact digital television antenna of claim 14 wherein said elongated support bracket is formed in a channel of non-conductive material and wherein said ultrahigh frequency reflector is held in formed opposing tapered slots in said channel.

17. The compact digital television antenna of claim 14 wherein said ultrahigh frequency antenna comprises two opposing V-shaped dipoles.

18. The compact digital television antenna of claim 14 further comprising:

a pair of ultrahigh frequency stub elements connected to said sides of each of said pair of very high frequency dipoles at a set distance from said pair of signal outputs.

19. The compact digital television antenna of claim 18 wherein each said ultrahigh frequency stub element comprises:

an elongated body portion;

an angled connection portion integral with said elongated body portion, said angled portion terminating in a loop for connecting to said opposing side of said very high frequency dipole.

* * * * *